United States Patent [19]

Mazelie

[11] Patent Number: 4,478,230

[45] Date of Patent: Oct. 23, 1984

[54] LIGHTER FORMING AN EXTINGUISHING ASH-TRAY

[76] Inventor: Yves Mazelie, 12, rue Herran, Paris, France

[21] Appl. No.: 329,893

[22] Filed: Dec. 11, 1981

Related U.S. Application Data

[63] Continuation-in-part of Ser. No. 095,477, Nov. 19, 1979, abandoned, which is a continuation of Ser. No. 815,540, Jul. 14, 1977, abandoned.

[30] Foreign Application Priority Data

Jul. 22, 1976 [FR] France ..... 76 22391
Apr. 20, 1977 [FR] France ..... 77 11850

[51] Int. Cl.[3] ..... A24F 19/10

[52] U.S. Cl. ..... 131/234; 131/235 R; 431/253

[58] Field of Search ..... 131/234, 240, 240 GG, 131/231, 238, 185; 431/253

[56] References Cited

U.S. PATENT DOCUMENTS

| | | | |
|---|---|---|---|
| 1,928,041 | 9/1933 | Windesheim | 131/234 X |
| 2,910,073 | 10/1959 | Lookholder | 131/240 GG |
| 3,276,455 | 10/1966 | Blanchard | 131/240 GG |
| 4,108,153 | 8/1978 | Pearson | 131/235 R |

*Primary Examiner*—Stephen C. Pellegrino

[57] ABSTRACT

The lighter comprises a chamber for receiving ashes of cigarettes or cigars, said chamber having at least one wall formed by a portion of the body of the lighter and comprising an opening bored in a wall of said body and normally closed by a flap beneath which is mounted an apertured grate.

8 Claims, 7 Drawing Figures

LIGHTER FORMING AN EXTINGUISHING ASH-TRAY

CROSS REFERENCE TO RELATED APPLICATIONS

This is a Continuation in Part of my copending application Ser. No. 095,477, filed Nov. 19, 1979, now abandoned which was a Continuation of parent application Ser. No. 815,540, filed July 14, 1977 and now abandoned.

TECHNICAL FIELD

The field of art to which the invention relates is that of accessories for tobacco smoking.

BRIEF SUMMARY OF THE INVENTION

It is well known that many fires, particularly forest fires, are caused by the carelessness of smokers who throw away burning or not completely extinguished cigarettes. If the responsibility of those careless smokers is important, it must be taken into consideration that it is sometimes difficult for them to extinguish their cigarette in a safe way because most of the time they do not have an element to do so and, by laziness or unconcern, most of the time they are satisfied just in throwing away their burning cigarette without any other care.

The invention copes with the above mentioned disadvantages in enabling the smokers to have always at their disposal, wherever the place they are, means for extinguishing their cigarette in a safe way.

The invention originates in the fact that the smokers have always a lighter to light their cigarette and it has thus been thought that the lighter by itself could be used also to extinguish the cigarettes while moreover giving the smokers the reflex to extinguish said cigarettes on the same grounds they have the reflex to light their cigarettes.

The lighter of the invention comprises a chamber of which one wall at least is formed by a portion of the body of the lighter, said chamber comprising means for receiving and maintaining at least up to their extinction, the ashes of a cigarette or of a cigar.

Various other features of the invention are moreover shown in the following detailed description.

DETAILED DESCRIPTION OF THE DRAWINGS

Embodiments of the invention are shown, by way of examples, in the accompanying drawings.

DETAILED DESCRIPTION OF THE INVENTION

Figure 1:
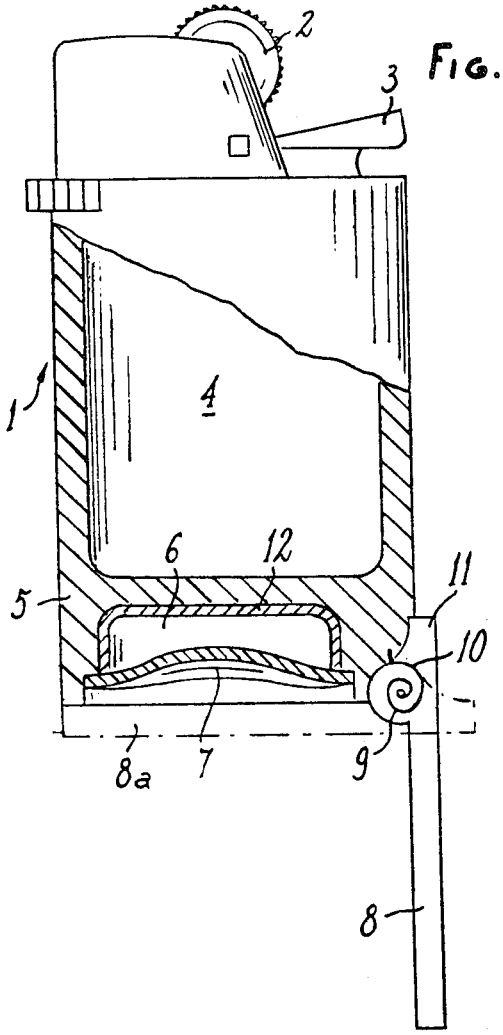
FIG. 1 is a partly exploded elevation view of a lighter forming an extinguisher and made according to the invention.
Figure 2:
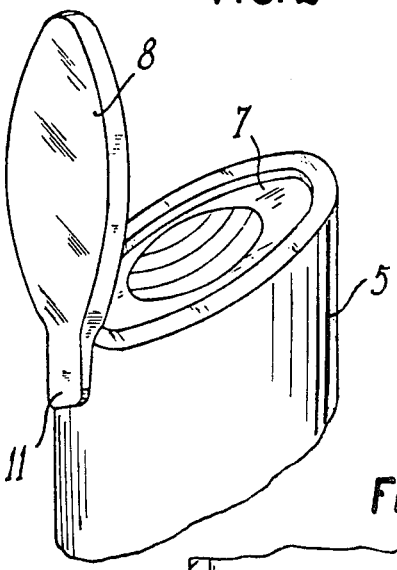
FIG. 2 is a perspective view from the bottom of the lighter of FIG. 1.

The lighter, represented in FIG. 1, is generally shown at 1 and comprises in a well-known way, at its upper portion, a serrated small wheel 2 and an operating pawl 3 to open the gas or other fluid fuel tank 4 which is formed in the body 5 of the lighter. According to the invention, there is provided, in the lower portion of the body 5, a chamber 6 of which one side is formed by a concave grate 7 which is embedded and fixed in the body 5. In addition, a pivotally mounted flap 8 is hinged on a pin 9, this flap being urged by a spring 10 which tends to bring it into a closing position 8*a* in which it entirely covers the bottom of the lighter and, consequently, closes both the grate 7 and the chamber 6. To facilitate operation of the flap 8, it is advantageous that this flap will have a protruding operating member 11, or another similar means. When it is desired to extinguish a cigarette or a cigar, it suffices to take the lighter in the hand, to turn it as shown in FIG. 2, and to rotate the flap 8 by operating the lug 11, for example with the thumb, in the same way that the thumb is used on the serrated small wheel 2 and the paul 3 when lighting a cigarette or a cigar. In this manner, the flap uncaps the grate 7 on which it is possible to crush the cigarette or the cigar whose ashes fall into the chamber 6. Then the lug 11 is released and the spring 10 brings the flap back to its initial position. Thus the ashes have no chance to fall out of the chamber whatever be the position in which the lighter is then placed. It is advantageous, as shown in FIG. 1, that the chamber 6 be coated or lined with a metallic fitting 12, particularly when the body 5 is made of plastic material.

In the above described embodiment, it is advantageous that the grate 7 be removably placed, for example it can be fastened with a catch in the body 5 or only held by friction. It is thus possible to remove the grate to throw away the ashes contained in the chamber 6 after several uses of the extinguisher lighter.

Figure 3:
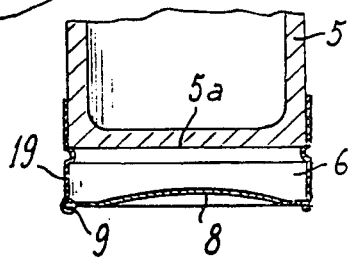
FIG. 3 is a partly exploded elevation view similar to FIG. 1, showing a variant of embodiment.

A variant of this embodiment is illustrated in FIG. 3 according to which the chamber 6 of FIG. 1 is formed between the bottom 5*a* of the body 5 of the lighter and a sleeve 19 which is removably fixed on the end of the lighter. The sleeve 19 supports the pin 9 and the flap 8 described with reference to FIG. 1. Thus, in this embodiment, there is found a structure quite comparable to that of FIG. 1 with the additional advantage that the sleeve 19 can, as desired, be separated from the body 5 of the lighter to facilitate draining of the ashes contained in the chamber 6.

Figure 4:
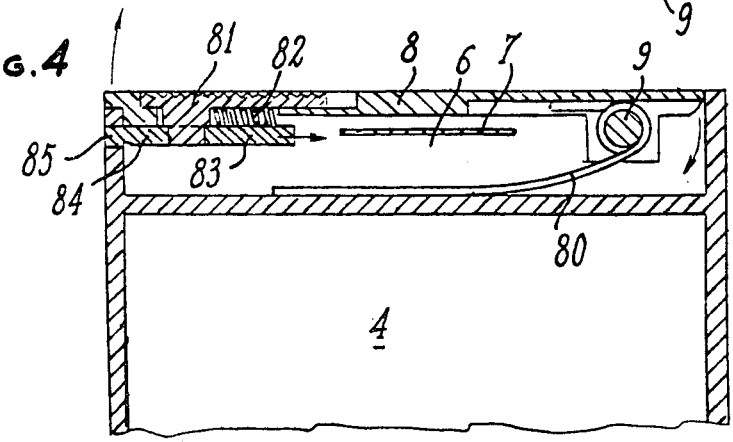
FIG. 4 is a partial view similar to that of FIG. 1 of a variant of the means for closing the ash receiving chamber.
Figure 5:
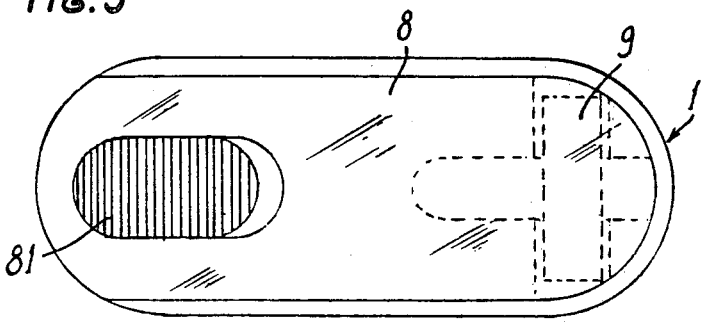
FIG. 5 is a top view of the variant of FIG. 4.

FIGS. 4 and 5 show a variant of the means for keeping the cover 8 closed on the chamber 6. As shown, the chamber 6 is mounted on the fuel tank 4 and is closed by the cover 8 pivotally mounted on the pin 9, while, the grate 7 is provided within the chamber 6.

A leaf spring 80 is pivotally mounted around the pin 9 and bears on the one hand on the bottom of the chamber 6 and the other hand on the cover 8 in a recess provided therefor. The cover 8 carries a movable part 81 urged by a spring 82 and sliding on the surface of the cover 8. The movable part 81 supports a member 83 having a tooth shaped part 84. The tooth shaped part 84 of the member 83 is provided in register of a recess 85 in the wall of the chamber 6.

Then, when the movable part 81 is pressed rearward against the action of the spring 82, the tooth shaped part 84 escapes from the recess 85, which frees the cover 8 urged by the leaf spring 80. For closing the cover 8 it is sufficient to swing the cover on the chamber 6 against action of the leaf spring 80. Then the tooth shaped part 84 of the member 83 enters the recess 85 and maintains the cover 8 closed.

Figure 6:
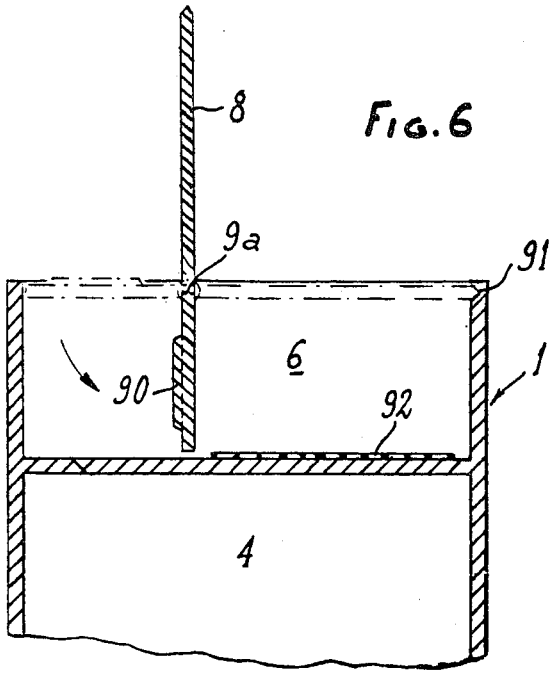
FIG. 6 shows another variant of the means for closing the ash receiving chamber.
Figure 7:
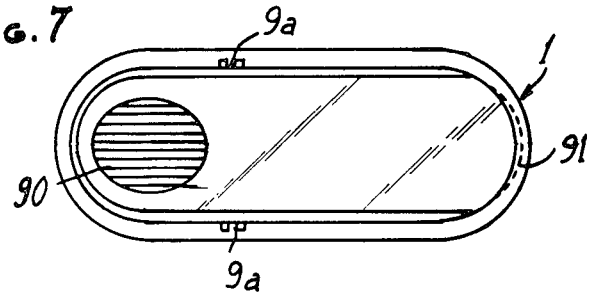
FIG. 7 is a top view of the variant of FIG. 6.

In the variant of FIGS. 6 and 7, the cover 8 is pivotally mounted by a pin 9a in a wall of the chamber 6 and is provided at one end with a small protrusion 90, while the other end of the cover 8 is tapered in order to engage a recess 91 of the wall of the chamber 6. In this embodiment, no grate is preferably provided and the bottom of the chamber 6 is at least partly covered with a corrugated plate or the like 92.

Then just by gently pressing on the small protrusion 90, the tapered end of the cover 8 resiliently escapes from the recess 91 and uncovers the chamber 6. It is then possible to rub the burning end of the cigarette on the corrugated plate 92. In order to increase the ease with which the cigarette is extinguished, there can be provided in the chamber 6 a cartridge of rock or glass wool as an extinguishing member. For closing the chamber 6, it suffices to place a thumb near the tapered end of the cover and to press down causing the tapered end to enter in engagement in the recess 91 by mere resiliency of the cover 8.

Naturally, the various closure devices for opening and closing the cover shown in FIGS. 4–7 can be used in combination with the metal lining and concave grate shown in FIGS. 1 and 2 and with the removable sleeve shown in FIG. 3. Thus, while particular embodiments of the invention have been illustrated, it is to be understood that the scope of the invention is to be limited only by the appended claims.

I claim:

1. A lighter with an ash-receiving chamber, comprising:

a body made of a synthetic material and including a fuel storage chamber;

fuel igniting means attached to said body;

container means including a portion of said body and defining an open-ended ash-receiving chamber having a bottom wall and side walls;

extinguishing means coupled to said container means;

a hinged cover pivotally attached to said container means and movable between an open position in which said extinguishing means is exposed to allow the crushing of the burning end of a cigar or cigarette against said extinguishing means, and a closed position in which said cover seals said chamber to smother the ashes and prevent the spilling out thereof;

closure means for normally retaining said cover in said closed position;

manually engagable handle means for defeating said closure means and allowing said cover to move from said closed position to said open position;

wherein said cover is pivotable about a point proximate its center and wherein said closure means includes a recess and an engagable resilient protrusion, one of said recess and said protrusion being located on one end of said cover and the other of said recess and said protrusion being located at a corresponding position on said container means, and wherein said handle means is located on said cover at a point on said cover remote from the pivot point.

2. The lighter as claimed in claim 1 wherein said extinguishing means is a corrugated plate attached to said container means.

3. The lighter as claimed in claim 1 further including replaceable nonflammable means held within said container means for inhibiting fires therein.

4. The lighter as claimed in claim 3 wherein said nonflammable means is a cartridge of glass wool.

5. The lighter as claimed in claim 3 wherein said nonflammable means is a cartridge of rock.

6. The lighter as claimed in claim 1, wherein said extinguishing means is an apertured metallic concave grate removably attached to said container means spaced from said bottom wall and covering the open end of said chamber.

7. The lighter as claimed in claim 1, further including a metal linear within said chamber.

8. The lighter as claimed in claim 1, wherein said container means includes a removable sleeve member forming said side walls and frictionally engaging said body, such that said sleeve member, said extinguishing means, said cover, said closure means, and said handle means may be removed from said body as a unit to allow emptying of the chamber.

* * * * *

UNITED STATES PATENT AND TRADEMARK OFFICE

CERTIFICATE OF CORRECTION

PATENT NO. : 4,478,230

DATED : October 23, 1984

INVENTOR(S) : YVES MAZELIE

It is certified that error appears in the above-identified patent and that said Letters Patent are hereby corrected as shown below:

Column 4, line 38, change "linear" to ---liner---.

Signed and Sealed this

*Thirtieth* Day of *July 1985*

[SEAL]

*Attest:*

DONALD J. QUIGG

*Attesting Officer*

*Acting Commissioner of Patents and Trademarks*